US005896112A

United States Patent [19]

Bickford et al.

[11] Patent Number: 5,896,112

[45] Date of Patent: Apr. 20, 1999

[54] ANTENNA COMPENSATION FOR DIFFERENTIAL THERMAL EXPANSION RATES

[75] Inventors: Wayne Francis Bickford, Epping; Albert David Kozlovski, Atkinson, both of N.H.; Thomas Paul Lashua, Woburn, Mass.

[73] Assignee: The Whitaker Corporation, Wilmington, Del.

[21] Appl. No.: 08/785,403

[22] Filed: Jan. 22, 1997

[51] Int. Cl.[6] ..... H01Q 1/42

[52] U.S. Cl. ..... 343/872; 343/829; 343/830

[58] Field of Search ..... 343/770, 810, 343/811, 812, 813, 817, 818, 829, 830, 846, 848, 872; 361/715, 719, 720, 753, 818; 174/51

[56] References Cited

U.S. PATENT DOCUMENTS

| | | | |
|---|---|---|---|
| 3,293,646 | 12/1966 | Brueckmann | 343/830 |
| 3,969,730 | 7/1976 | Fuchser | 343/770 |
| 4,031,537 | 6/1977 | Alford | 343/872 |
| 4,749,997 | 6/1988 | Canonico | 343/872 |
| 4,851,859 | 7/1989 | Rappaport | 343/830 |

*Primary Examiner*—Donald T. Hajec
*Assistant Examiner*—Tho Phan
*Attorney, Agent, or Firm*—Gerald K. Kita

[57] ABSTRACT

An antenna (1) has a radome (2) and a conducting ground plane (6) bridging between conducting end caps (4), a circuit board (5) supported on the ground plane (6), rf antenna elements (7) on the circuit board (5), opposite ends of the ground plane (6) being slidable relative to respective end caps (4) in response to thermal expansion of the ground plane (6), and the circuit board (5) being slidable relative to the ground plane (6) in response to thermal expansion of the ground plane (6).

7 Claims, 6 Drawing Sheets

ANTENNA COMPENSATION FOR DIFFERENTIAL THERMAL EXPANSION RATES

FIELD OF THE INVENTION

The present invention relates to an antenna construction that compensates for thermal expansion of different parts of the antenna.

BACKGROUND OF THE INVENTION

An antenna is constructed as an array of conducting, planar antenna elements on a circuit board, combined with a ground plane and a radome that provides an enclosure for the circuit board. According to one example, the radome provides an enclosure, not only for the circuit board, but also, for the ground plane.

When the antenna is exposed to ambient temperature fluctuations, the different parts of the antenna undergo thermal expansion at different rates, as well as thermal contraction, at different rates. For example, the radome expands and contracts at different rates than the ground plane. It would be desirable to relieve internal stresses in the radome of the antenna due to differential thermal expansion and contraction of the radome and the ground plane. It would further be desirable to isolate the circuit board of the antenna from internal stress that would result from differential thermal expansion and contraction among the different parts of the antenna.

SUMMARY OF THE INVENTION

An antenna according to the invention is constructed with a radome and a ground plane that expands and contracts at different rates, the radome being advantageously relieved of internal stresses that would result from differential thermal expansion and contraction rates of the radome and the ground plane.

According to an embodiment, a radome and a ground plane bridges between end caps that close opposite ends of the radome to form an enclosure for a circuit board, and the end caps slidably couple to the ground plane in response to differential thermal expansion and contraction of the radome and the ground plane.

Further, according to an embodiment of the invention, an antenna is constructed with an array of antenna elements on a circuit board, the circuit board being advantageously isolated from internal stress that would result from differential thermal expansion and contraction among the different parts of the antenna.

According to a further embodiment, a circuit board that carries an array of antenna elements is slidably mounted on a ground plane of an antenna, and the circuit board is slidable relative to the ground plane in response to thermal expansion of the ground plane.

An embodiment of the invention will now be described by way of example with reference to the accompanying drawings, according to which:

DETAILED DESCRIPTION

Figure 1:
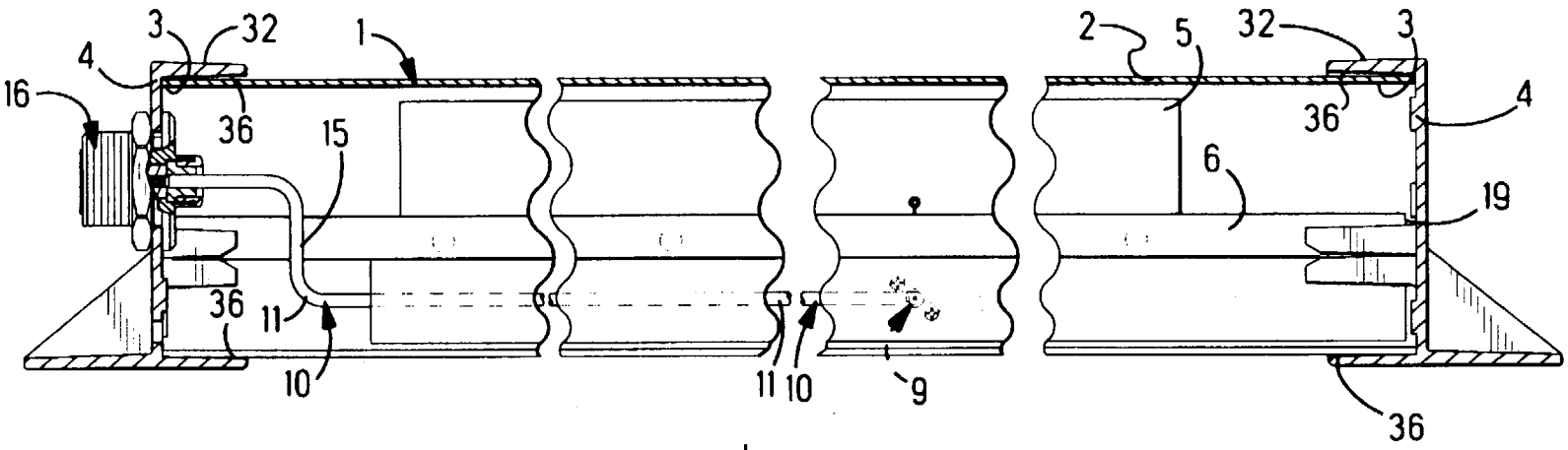
FIG. 1 is a fragmentary side view of an antenna with parts partially cut away.

With reference to FIG. 1, an antenna 1 comprises, a tubular radome 2 having open ends 3 covered by end caps 4. The radome 2 encloses a circuit board 5. A conducting ground plane 6 of the antenna 1 bridges between the end caps 4. The radome 2 and the ground plane 6 are fabricated of different materials that expand and contract at different rates of thermal expansion and contraction. Yet the radome 2 and the ground plane 6 are advantageously relieved of internal stresses that would result from differential thermal expansion and contraction of the radome 2 and the ground plane 6.

The radome 2 and the ground plane 6 bridge between the end caps 4 that close opposite ends of the radome 2 to form an enclosure for the circuit board 5, and the end caps 4 slidably couple to the ground plane 6 in response to differential thermal expansion and contraction of the radome 2 and the ground plane 6.

Figure 3:
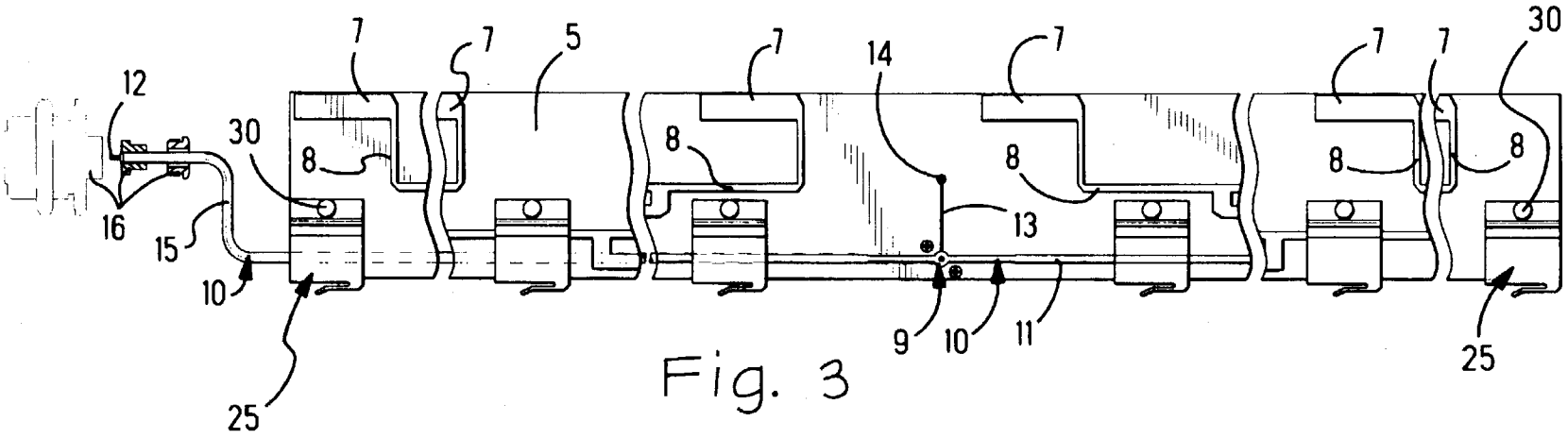
FIG. 3 is a fragmentary side view of multiple antenna elements on a circuit board together with a coaxial cable that feeds the antenna elements.
Figure 4:
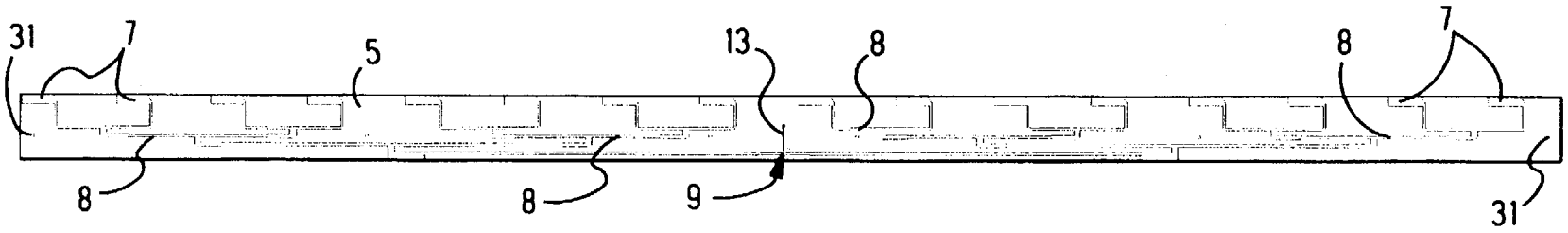
FIG. 4 is a side view of the circuit board as shown in FIG. 3, the side view being divided into parts.
Figure 5:
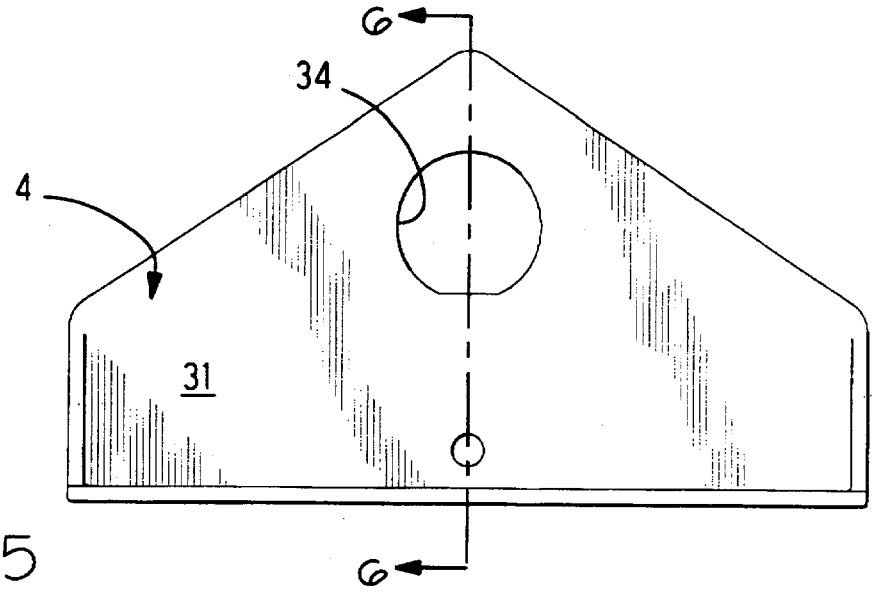
FIG. 5 is an end view of an end cap of the antenna as shown in FIG. 1.
Figure 6:
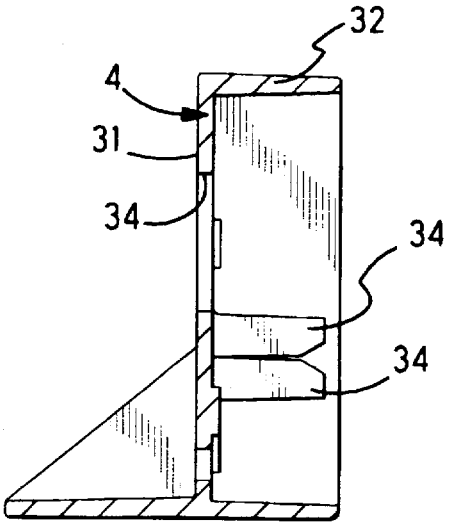
FIG. 6 is a section view taken along the line 6—6 of FIG. 5.
Figure 7:
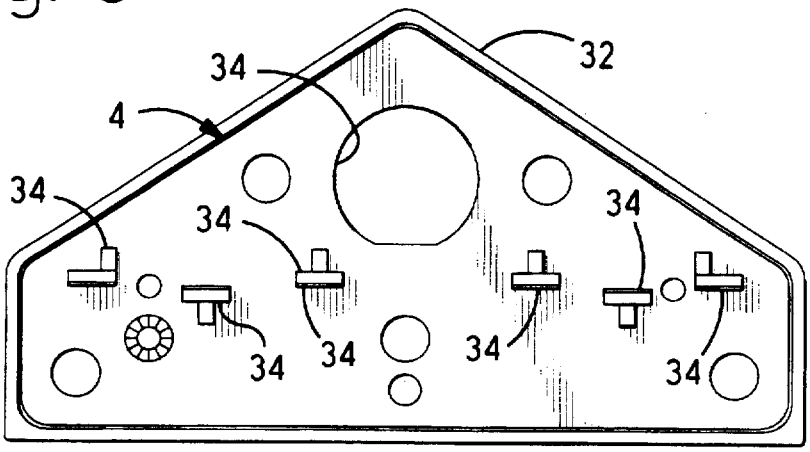
FIG. 7 is an interior end view of the end cap as shown in FIG. 5.
Figure 8:
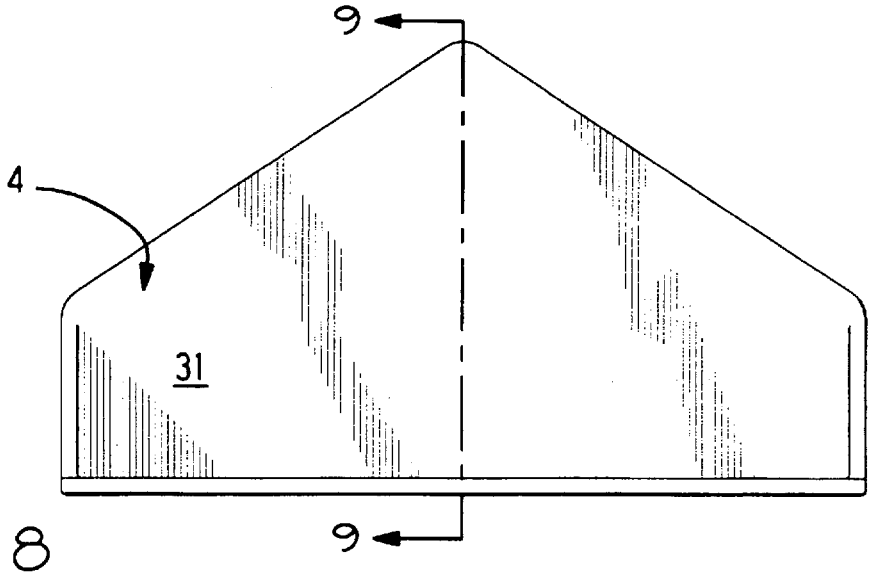
FIG. 8 is an end view of an end cap of the antenna as shown in FIG. 1.
Figure 9:
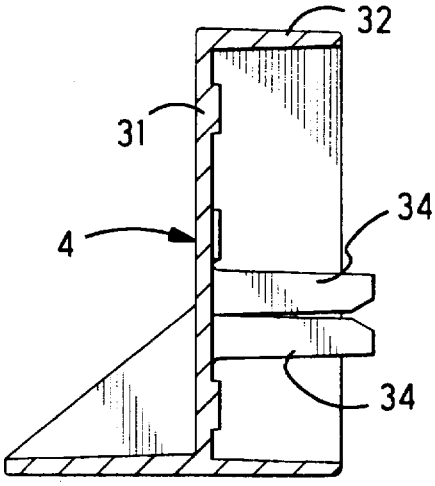
FIG. 9 is a section view taken along the line 9—9 of FIG. 8.
Figure 10:
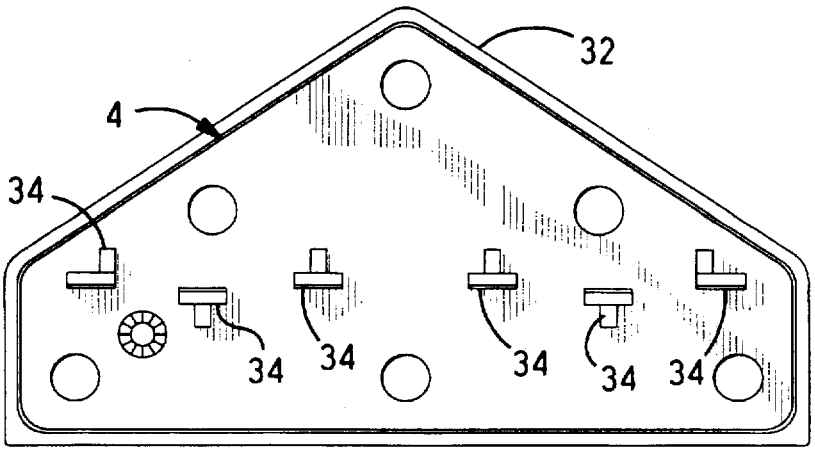
FIG. 10 is an interior end view of the end cap as shown in FIG. 8.

Further, according to the invention, the antenna 1 comprises, an array of rf, radio frequency, antenna elements 7, FIGS. 3 and 4, on the circuit board 5, the circuit board 5 being advantageously isolated from internal stress that would result from differential thermal expansion and contraction among the different parts of the antenna 1.

According to a further embodiment, the circuit board 5 that carries an array of antenna elements 7 is slidably mounted on the ground plane 6 of an antenna 1, and the ground plane 6 is slidable relative to the circuit board 5 in response to thermal expansion of the ground plane 6.

With reference to FIGS. 3 and 4, the circuit board 5 will now be described. The array of antenna elements 7 are planar conducting areas on a first exterior surface of the circuit board 5. The antenna elements 7 comprise a signal carrying portion of a stripline. The circuit board 5 is constructed as a parallel stripline antenna component. Thus, the antenna elements 7 that comprise the signal carrying portion of the stripline are in parallel with a stripline of similar configuration on the opposite side of the circuit board 5. The stripline on the opposite side of the circuit board 5 is referenced to ground, or earth, electrical potential.

The circuit board 5 and the antenna elements 7 are fabricated by known printed circuit board 5 manufacturing techniques. As shown, the antenna elements 7 are connected to conducting feed lines 8 extending from a center feed 9. The antenna elements 7 are center fed by a semi-rigid coaxial cable 10 of known construction. For, example, the semi-rigid coaxial cable 10 has a solid copper jacket 11 concentrically surrounding a solid dielectric material. In turn, the dielectric material concentrically surrounds a signal carrying, central conductor 12, FIG. 3, of the coaxial cable 10 that feeds the antenna elements 7. The central conductor 12 of the coaxial cable 10 is electrically connected by solder to the center feed 9 on the circuit board 5.

The jacket 11 of the coaxial cable 10 is electrically connected to a ground circuit path 13 on the circuit board 5. The ground circuit path 13 is connected to a plating lined through hole 14 through the circuit board 5. In turn, the plating lined through hole 14 connects with the stripline on the opposite side of the circuit board 5 that is referenced to ground, or earth, electrical potential. A lightning arrest feature of the antenna 1 will now be described. The antenna 1 provides a lightning arrest feature that protects the circuit board 5 from lightning. The ground circuit path 13 will shunt a current from a lightning strike to the jacket 11 of the coaxial cable 10. The ground circuit path 13 is a one-quarter wavelength ground path providing effective isolation.

The coaxial cable 10 has an offset portion 15, FIGS. 1 and 3, along its length. An end of the coaxial cable 10 is terminated in a known manner with a known coaxial electrical connector 16 that extends through an end cap 4. The coaxial connector 16 provides an electrical disconnect coupling for the coaxial cable 10.

Figure 16:
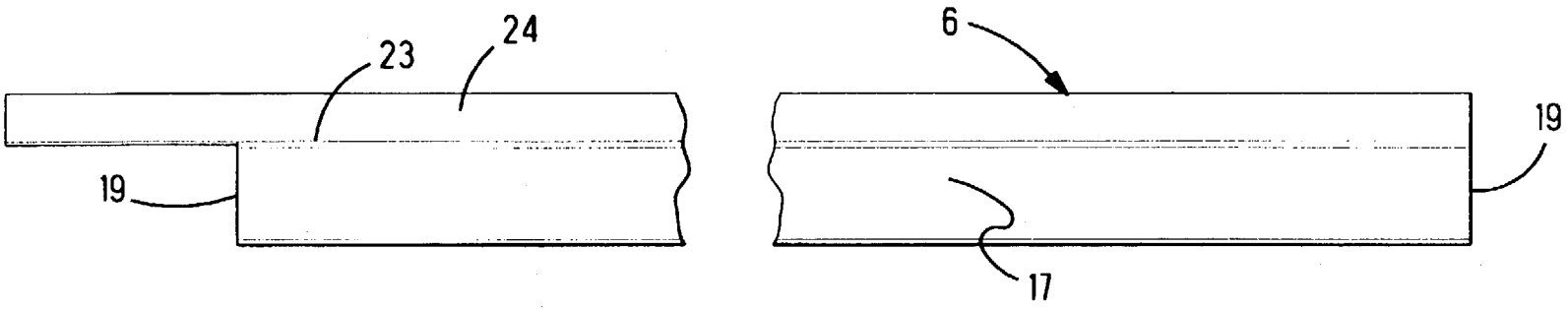
FIG. 16 is a side view of the ground plane as shown in FIG. 14.
Figure 15:
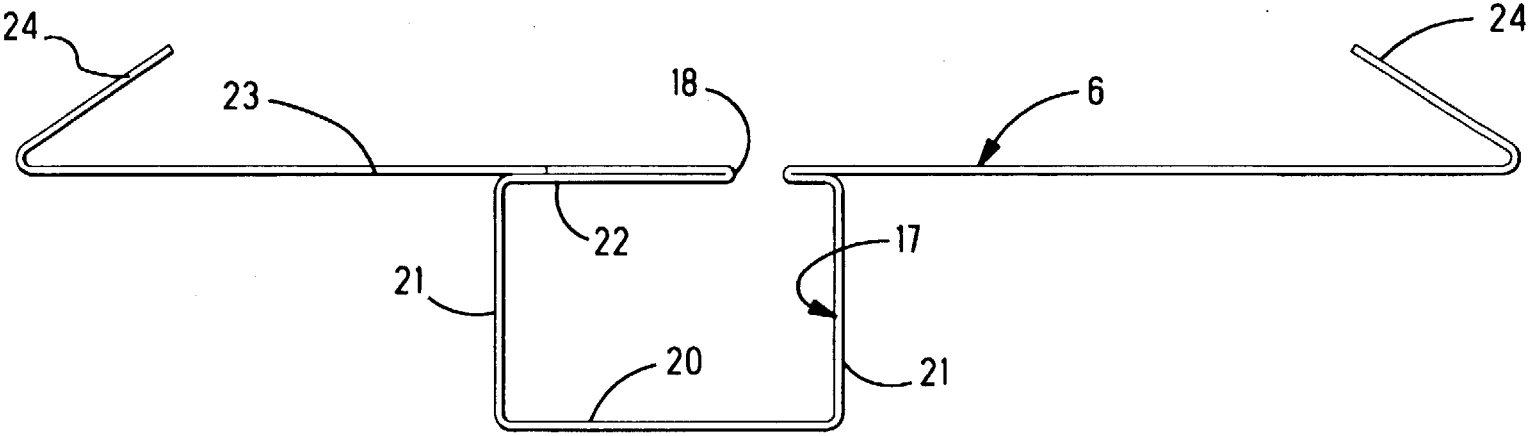
FIG. 15 is an end view of a ground plane of the antenna shown in FIG. 1.

With reference to FIGS. 15 and 16, the ground plane 6 will now be described. The ground plane 6 comprises a folded metal sheet, for example, a folded aluminum sheet. The ground plane 6 is folded lengthwise multiple times to form a generally tubular track 17 with a lengthwise opening 18. For example, the opening 18 that extends between open ends 19 of the track 17. The track 17 comprises, a bottom wall 20 connected by folds to side walls 21, and the side walls 21 being folded over toward each other to form a top wall 22 that has the lengthwise opening 14. The ground plane 6 is doubled back on itself along the edges of the lengthwise opening 18 to provide a flattened, planar portion 23. Lengthwise edges 20 of the ground plane 6 are folded back on themselves to provide lengthwise fins 24 extending angularly from the flattened, planar portion 23.

Figure 12:
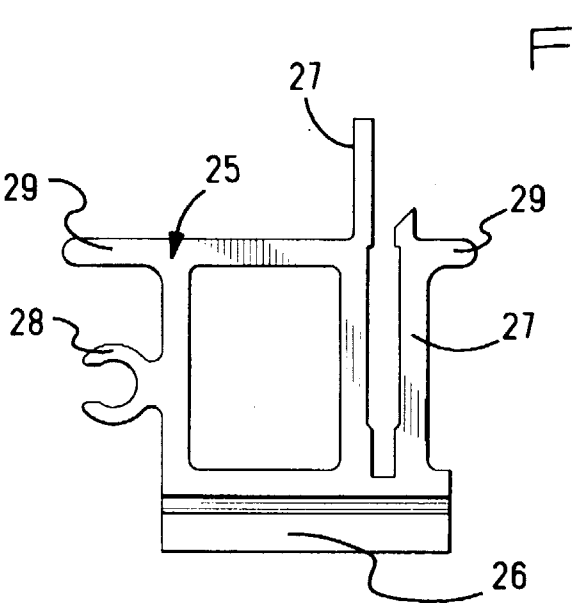
FIG. 12 is an end view of the holder as shown in FIG. 11.
Figure 11:
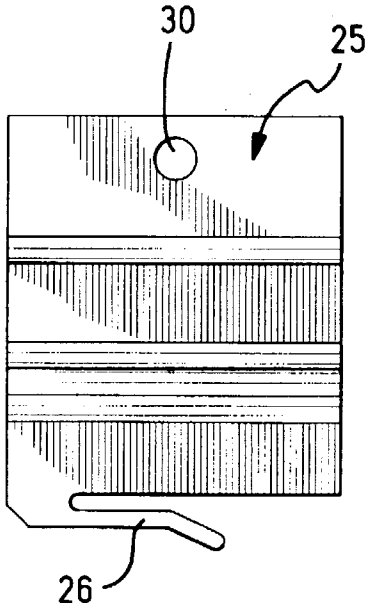
FIG. 11 is a side view of an insulating holder.
Figure 13:
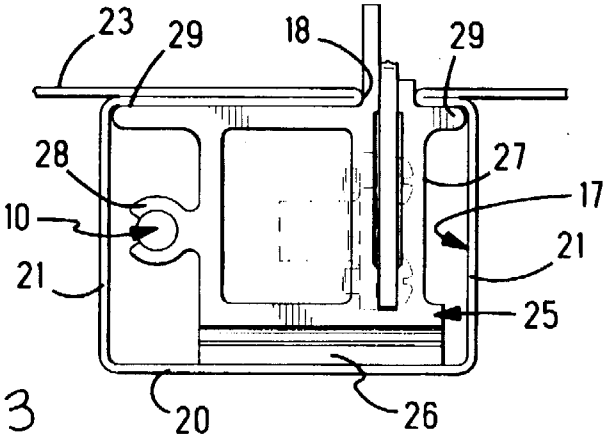
FIG. 13 is an end view of the holder mounted to a circuit board and a ground plane of the antenna as shown in FIG. 1.

With reference to FIGS. 11, 12 and 13, insulating holders 25 for the circuit board 5 will now be described. The holders 25 are duplicates of one another, and are cut to length from, for example, a continuous extrusion of unfilled polypropylene. Each holder 25 is of unitary construction, having a resilient cantilever beam 26 at the base, a pair of alignment fingers 27 projecting from the base and a C-shaped clip 28 extending to one side of the holder 25. Respective alignment fingers 27 have projecting standoffs 29 extending laterally from the respective alignment fingers 27.

Multiple holders 25 are attached to the circuit board 5. For example each holder 25 has a mounting aperture 30 that aligns with a corresponding mounting aperture 31 through the circuit board 5. The aligned mounting apertures 30, 31 are adapted to receive a fastener, not shown. The alignment fingers 27 of each holder 25 overlap opposite sides of the circuit board 5. The clip 28 of each holder 25 resiliently clips onto the coaxial cable 10 to retain the coaxial cable 10 beside the circuit board 5 and spaced from the circuit board 5.

With reference to FIGS. 1 and 13, the assembled combination comprising, the circuit board 5, the coaxial cable 10 and the holders 21, is slidably inserted into an open end 19 of the track 17. The holders 25 are slidably distributed along the track 17, with the cantilever beams 26 being resiliently biased against the bottom wall 20 of the track 13. The standoffs 29 oppose opposite side walls 21 of the track 17. The circuit board 5 projects edgewise through the longitudinal opening 18 in the track 17. Because the circuit board 5 is dielectric, and the ground plane 6 is aluminum, they have different rates of thermal expansion and contraction. The circuit board 5 is slidable relative to the ground plane 6 in response to thermal expansion of the ground plane 6. The circuit board 5 is isolated from internal stress that would be caused by differential thermal expansion and contraction of the parts of the antenna 1. Next, the ground plane 6 is assembled with the end caps 4.

Figure 2:
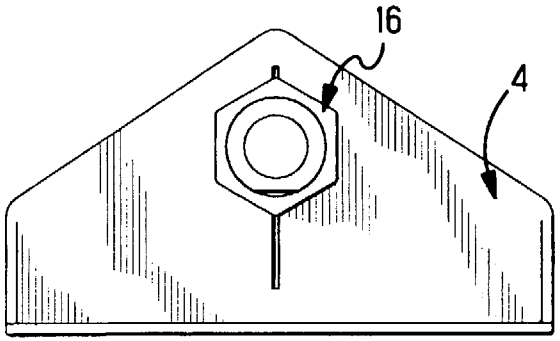
FIG. 2 is an end view of the antenna as shown in FIG. 1 with parts partially cut away.

With reference to FIGS. 5–10, the end caps 4 will now be described. Each of the end caps 4 is a unitary casting of aluminum alloy having a plate 31 encircled by a relatively wide side wall 32 along a pentagonal periphery of the plate 31. One of the end caps 4 has an opening 33 through the plate 31 for receiving and mounting the electrical connector 16, as shown in FIG. 2. On an interior side of each end cap 4 are two rows of projecting bosses 34. The rows of bosses 34 are spaced apart a dimension of about the thickness of the ground plane 6. The bosses 34 are received over an edge on the end of the ground plane 6, with an interference fit across the thickness of the ground plane 6. Accordingly, the ground plane 6 is suspended slidably along its edges that are retained with an interference fit between pairs of the bosses 34.

The combination of the ground plane 6 and the end caps 4 provide a lightning arrest feature to shunt lightning strikes. The quarter wave length ground circuit path 13 shunts lightning strikes from the center portion of the radome to protect the circuit board 5 from lightning. During thermal expansion and thermal contraction of the ground plane 6, opposite ends of the ground plane 6 are slidable relative to the bosses 34 on respective end caps 4 in response to such thermal expansion and thermal contraction of the ground plane 6. The coaxial cable 10 is terminated with the coaxial connector 16 that is mounted in the opening 34 through one of the end caps 4.

Next, the radome 2 is assembled over the end caps 4 to enclose the circuit board 5, the antenna elements 7, the ground plane 6 and the coaxial cable 10 that provides a feed for the antenna elements 7.

Figure 14:
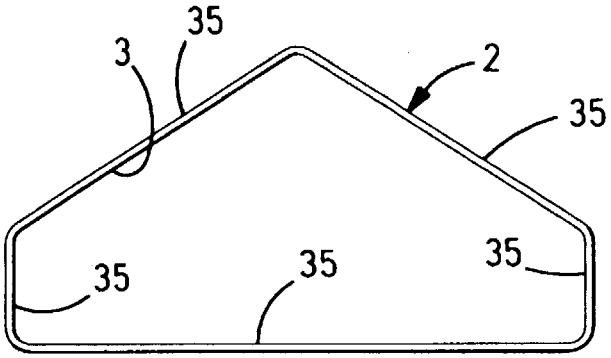
FIG. 14 is an end view of a radome of the antenna as shown in FIG. 1.

With reference to FIG. 14, the radome 2 will now be described. The radome 2 comprises a hollow, unitary tube having multiple walls 35 connecting to form a pentagon. The radome 2 is constructed of a fire resistant polyester resin strengthened by glass fibers of mat and roving constructions, and stabilized with ultraviolet inhibitors. For example, the radome 2 is manufactured as a continuous hollow tube that is pulled from an extrusion die, as contrasted from a molten extrudate under pressure and urged forwardly through an extrusion die.

The end caps 4 are inserted into opposite ends 3 of the radome 2, with the side walls 32 of the end caps 4 being overlapped by the radome 2. A water resistant epoxy based adhesive 36 joins and seals the end caps 4 in the radome 2.

Care must be taken to space apart the end caps 4 before joining them to the radome 2. Because the ground plane 6 is aluminum, and the radome 2 is a dielectric, the ground plane 6 and the radome 2 have different rates of thermal expansion and contraction. It is important that the end caps 4 are spaced apart sufficiently to allow for differential thermal expansion of the ground plane 6 and the radome 2..

Because the ground plane 6 is slidable relative to the end caps 4, the ground plane 6 is free to lengthen and shrink to relieve internal stresses due to thermal expansion and contraction. The radome 2 is isolated from internal stresses due to differential thermal expansion of the different parts of the antenna 1. The offset portion 15 along the length of the coaxial cable 10 allows the cable 10 to lengthen and shrink due to thermal expansion and contraction, to limit axial force on the electrical connections of the cable 10 to the circuit board 5 and to the coaxial connector 15.

Although a preferred embodiment of the invention has been disclosed, other embodiments and modifications of the invention are intended to be covered by the spirit and scope of the appended claims.

What is claimed is:

1. An antenna comprising: a conducting ground plane, a radome, the ground plane and the radome bridging between conducting end caps, a circuit board supported on the ground plane, rf antenna elements on the circuit board, opposite ends of the ground plane being slidable relative to respective end caps in response to thermal expansion of the ground plane, and the ground plane being slidable relative to the circuit board in response to thermal expansion of the ground plane.

2. An antenna as recited in claim 1 wherein, the end caps have projecting bosses extending lengthwise of the ground plane, and the ground plane is slidably received between the bosses.

3. An antenna as recited in claim 1 wherein, the circuit board is slidable along a track in the ground plane in response to thermal expansion of the ground plane.

4. An antenna as recited in claim 1 wherein, a feed of the antenna elements comprises a coaxial cable, and insulating clips along the ground plane retain the coaxial cable in spaced relationship from the ground plane.

5. An antenna as recited in claim 1 wherein, a ground path on the circuit board connects to an outer conductor on a coaxial cable to shunt a lightning strike.

6. An antenna as recited in claim 1 wherein, the circuit board is slidable along a groove in the ground plane in response to thermal expansion of the ground plane, and the ground plane is bent to form the groove.

7. An antenna as recited in claim 1 wherein, a feed of the antenna elements comprises a coaxial cable connected to the circuit board, and the coaxial cable being connected with a coaxial connector mounted to one of the end caps, and the coaxial cable being bent along its length to provide an offset section to relieve stress due to changes in length of the cable in response to thermal expansion.

* * * * *